United States Patent [19]

Biermann et al.

[11] 3,983,303

[45] Sept. 28, 1976

[54] METHOD OF MANUFACTURING ARTICLES FROM METAL COATED WITH A ZIRCONIUM NITRIDE LAYER

[75] Inventors: Udo Klaus Paul Biermann; Brian Lynch; Willibrordus Maria van de Wijgert, all of Eindhoven, Netherlands

[73] Assignee: U.S. Philips Corporation, New York, N.Y.

[22] Filed: Mar. 27, 1975

[21] Appl. No.: 562,495

[30] Foreign Application Priority Data

Apr. 16, 1974 Netherlands ..... 7405069

[52] U.S. Cl. ..... 428/457; 428/35; 427/433; 176/88

[51] Int. Cl.² ..... C23C 1/06; C23F 7/00

[58] Field of Search ..... 427/399, 433, 432, 431; 428/457, 472, 457; 148/31.5, 6.11; 29/195 A

[56] References Cited

UNITED STATES PATENTS

| | | | |
|---|---|---|---|
| 2,836,514 | 5/1958 | Munster et al. | 427/249 |
| 2,865,791 | 12/1958 | Ruppert et al. | 427/253 |
| 3,795,537 | 3/1974 | Van Thyne | 148/6.11 |

*Primary Examiner*—Ralph S. Kendall
*Attorney, Agent, or Firm*—Frank R. Trifari; Carl P. Steinhauser

[57] ABSTRACT

A method of manufacturing metal parts containing an element which is attacked by lead comprising coating the metal parts with zirconium nitride by treatment with a zirconium-containing metal melt.

4 Claims, 1 Drawing Figure

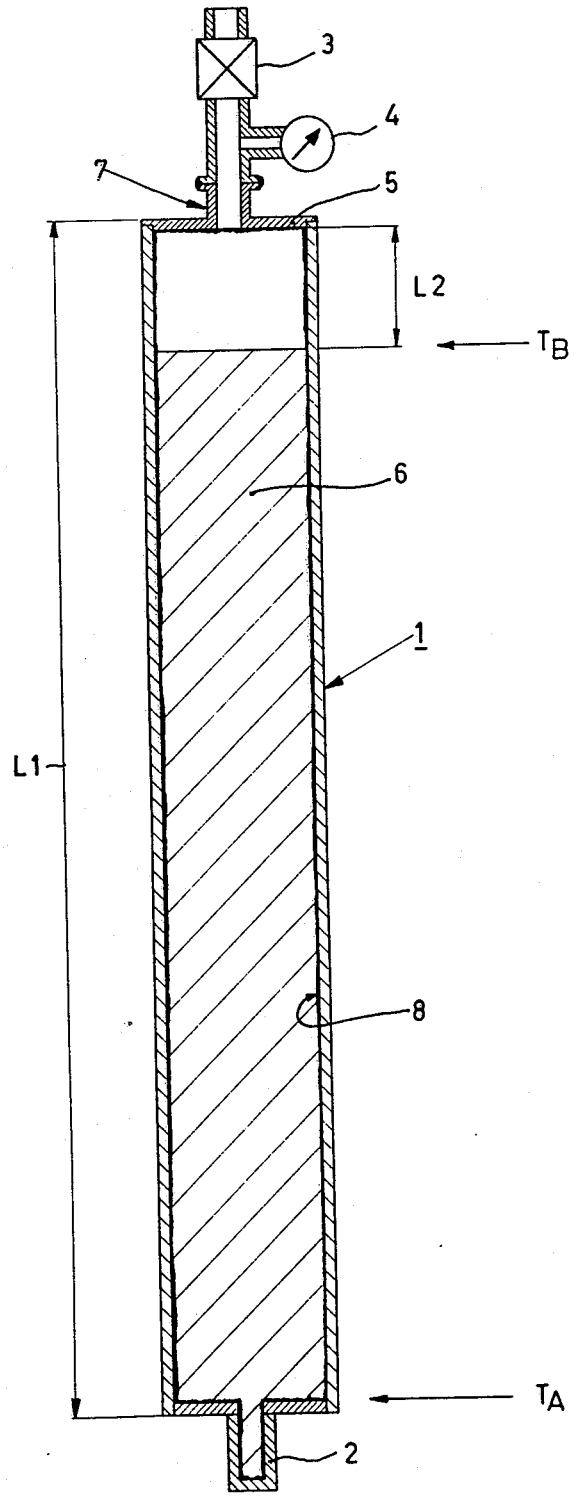
3
4
7
5
L2
$T_B$
6
1
L1
8
$T_A$
2

METHOD OF MANUFACTURING ARTICLES FROM METAL COATED WITH A ZIRCONIUM NITRIDE LAYER

The invention relates to a method of manufacturing articles from metal parts of which during use come into contact with a metal melt which entirely or partly consists of lead, by which method these parts are coated with a layer of zirconium nitride by a treatment with a zirconium-containing metal melt to prevent corrosion by the metal melt.

Such articles in the form of, for example, tubes, containers and component part of pumps are used in heat transport systems, for example, for cooling nuclear reactors, the heat transport fluid consisting of lead or an alloy of lead and bismuth and/or tin.

It is known that lead and lead alloys in the molten state are capable of dissolving nickel and to a lesser degree chromium. Hence it is not well posible, for example, for articles which in use come into contact with lead or lead alloys to be made of steels which contain nickel. It was found that iron is only slightly soluble in molten lead and lead alloys. Attack associated with mass transfer takes place in particular in apparatus in which molten lead or lead alloys are circulated and in circulation pass through a temperature gradient. Attack occurs in the region of highest temperature and the material dissolved owing to the attack is deposited in the lowest-temperature region. This may give rise to plugs in the tube system and, if a cooling system of a nuclear reaction is concerned, plugging may obviously have serious consequences. When using steels which contain no nickel or only a slight amount of nickel (in general less than 5% by weight), i.e. in general ferritic steels, together with bismuth and bismuth alloys it is sufficient to provide a protective coating of zirconium nitride on the surfaces which during use come into contact with molten bismuth or bismuth alloys. Such protective coating may be obtained by treating the metals to be coated with a solution of zirconium in molten bismuth. If the nitrogen content of the metal to be treated is insufficient to form zirconium nitride, the metal surface may previously be nitrided by methods generally used in metallurgy engineering. It is desirable to add zirconium as a corrosion inhibitor to the molten metals which during use come into contact with the metal surfaces provided with a zirconium nitride layer. This addition prevents cracks in the zirconium nitride layer, which may be due to unequal thermal expansion of the layer and the base metal, from giving rise to corrosion. On the parts of the metal surface which are exposed by cracks produced in the zirconium nitride layer the zirconium dissolved in the molten metal will immediately form a new zirconium nitride layer.

According to a recent publication: J. R. Weeks: "Lead, Bismuth, Tin and Their Alloys as Nuclear Coolants", Nuclear Engineering and Design 15 (1971) 363–372, in particular page 366, right-hand column, no protective layers can be obtained in the manner described on alloys which contain nickel, such as austenitic steels, see also U.S. Pat. No. 2,840,467.

This is an important disadvantage, because ferritic steels generally can be used only up to temperatures of about 750°C. Furthermore, from a point of view of high-temperature strength and structural stability (conversion of the body-centered cubic structure into the face-centered cubic structure may result in a change in volume of 1%) also it is desirable to use austenitic steels or metal alloys which are better capable of withstanding high temperatures.

It is an object of the present invention to provide a method of manufacturing articles from austenitic nickel-containing iron alloys which are capable of withstanding molten lead and lead alloys and can be used up to a temperature of about 1,000°C.

A method according to the invention is characterized in that the article is made of an austenitic alloy which contains more than 5% by weight of nickel and at least at its surface contains nitrogen, after which the surface is coated with a layer of zirconium nitride by contacting the surface with a solution of zirconium in molten lead at a temperature of 800°C or higher.

Surprisingly it was found that for the purpose of the invention the amount of zirconium which can be dissolved in molten lead at a temperature above 800°C is sufficient.

If the nitrogen content of the metal alloy to be treated is less than about 1,000 ppm, preferably the surface to be coated with zirconium nitride is previously nitrided. This may be effected by methods commonly use for this purpose in the art, for example, by a treatment with ammonia.

Good results were obtained with zirconium nitride layers of thickness about 1 $\mu$m. Such a layer is obtainable by a treatment with molten lead which contains 0.1 % by weight of zirconium. At temperatures between 850° and 1,000°C such a layer can be obtained in a few hours.

It was found that a zirconium nitride layer obtained by the method according to the invention is self-healing if the molten metal used as a heat transport agent contains zirconium.

The articles obtained by the method according to the invention show no corrosion, even after long use at temperatures up to 1,000°C.

Suitable metal alloys for use in the method according to the invention are, for example, the nitrogen-containing steels of the AISI 300 series.

The method according to the invention will now be described in more detail with reference to the accompanying drawing, the single FIGURE of which is a schematic sectional view of a test reactor, and to two Examples.

Referring now to the FIGURE, a test reactor 1 comprises a tube made of the metal to be tested and having an outer diameter of 30 mm, a wall thickness of 2 mm and an (outer) length $L_1$ of 200 mm. At the lower end it is provided with a closed part 2 which is sawn through when a metal melt 6 is to be removed from the reactor 1. At the upper end the reactor is provided with a cover 5 including a valve 3 and a manometer 4. The reactor 1 is filled through a filling tube 7 with the metal melt 6, whereupon the valve 3 and the manometer 4 are secured to the filling tube 7, for example by brazing. The amount of the metal melt 6 introduced into the reactor always is such as to leave a residual free space having an (inner) length $L_2$ of about 20 mm. Through the valve 3 this free space can be evacuated and filled with an inert gas.

EXAMPLE I

A reactor was made from an austenitic steel of the 18-8 type having the following composition 18 % by weight of Cr, 11 % by weight of Ni, 0.03 % by weight of C, 0.2 % by weight of N, the remainder being iron. The reactor was filled with molten lead. 5 g of zirconium in the form of small pieces were added to the molten lead and subsequently the entire reactor was heated to a temperature of 900°C and held at this temperature for 24 hours. After this treatment the liquid lead was removed from the reactor 1 through the discharge pipe 2 at a temperature of about 800°C. A dense layer of zirconium nitride a few microns thick has formed on the inner wall of the reactor.

If instead of molten lead a molten eutectic lead-bismuth alloy (43.5 % by weight of Pb and 56.5 % by weight of Bi) or a molten lead-bismuth-tin alloy (32.0 % by weight of Pb, 52.5 % by weight of Bi and 15.5 % by weight of Sn) was used, no dense zirconium nitride layer was obtained but corrosion occurred which proceeded at a rate which is only slightly lower than if the same alloys were used without the addition of zirconium. If no zirconium was added to the lead, the wall of the reactor vessel was corroded also. Reactor vessels internally coated with a zirconium nitride layer were filled with lead, containing 0.1 % by weight of zirconium, a eutectic lead-bismuth alloy containing 0.1 % by weight of zirconium and a eutectic lead-bismuth-tin alloy containing 0.1 % by weight of zirconium, respectively. The reactor, were heated so that the temperature at the lower end ($T_A$) was 850°C and that at the upper end ($T_B$) was 1,000°C. Mass transfer was mainly due to diffusion. After the reactor vessels had been heated in this manner for 4 weeks, no corrosion was found in any of them. This shows that the zirconium nitride layer provides effective protection and is self-healing.

EXAMPLE II

Tubes made of an austenitic alloy the composition of which was not exactly known, but was stated by the supplier to be: 19.00–20.00 % by weight of Ni, 18.50–21.00 % by weight of Co, 20.00 – 22.50 % by weight of Cr, 2.50 – 3.50 % by weight of Mo, 2.00 – 3.00 % by weight of W, 0.08 – 0.16 % by weight of C, 0.10 – 0.20 % by weight of N, Nb + Ta: 0.75 – 1.25 % by weight, at most 1.00 % by weight of Si, 1.00 – 2.00 % by weight of Mn, the remainder being iron, were placed in a lead melt to which an excess of zirconium had been added. After heating at 900°C for 24 hours zirconium nitride layers 1 μm thick had formed on the inner and outer walls of the tubes.

If the tubes were placed in a melt of zirconium-containing lead for 4 weeks, no corrosion occurred. The tubes were arranged vertically, their upper ends being at a temperature of 1,000°C and their lower ends at 850°C.

What is claimed is:

1. A method of manufacturing a metal article having parts which are subject to the influence of a metal melt containing lead which attacks constituents of the metal parts comprising the steps subjecting an austenitic alloy containing at least 5% by weight of nickel and having at least on the surface thereof nitrogen to the action of a metal melt containing zirconium in molten lead at a temperature of at least 800°C to form a layer of zirconium nitride on said alloy which resists the corrosive action of lead.

2. A method as claimed in claim 1 in which the alloy consists of 18% by weight of Cr, 11% by weight of Ni, 0.03% by weight of C, 0.2% by weight of N, and the remainder iron.

3. A method as claimed in claim 1 in which the alloy consists of 19 to 20% by weight of Ni, 18.5 to 21% by weight of Co, 20 to 22.5% by weight of Cr, 2.5 to 3.5% by weight of Mo, 2 to 3% by weight of W, 0.08 to 0.16% by weight of C, 0.10 to 0.20% by weight of N, 0.75 to 1.25% by weight of Nb + Ta, at least 1% by weight of Si, 1 to 2% by weight of Mn and the remainder iron.

4. Articles resistant to corrosion by exposure to molten lead consisting essentially of an austenitic alloy containing more than 5% by weight of nickel and a coating thereon of zirconium nitride.

* * * * *